United States Patent [19]

Walter et al.

[11] Patent Number: 4,459,080

[45] Date of Patent: Jul. 10, 1984

[54] LOG HANDLING ATTACHMENT

[75] Inventors: Llewellyn L. Walter, Perry; David T. Ping, Mentor, both of Ohio

[73] Assignee: Towmotor Corporation, Mentor, Ohio

[21] Appl. No.: 502,785

[22] Filed: Jun. 9, 1983

[51] Int. Cl.[3] ..... B66F 9/18; B66F 9/19

[52] U.S. Cl. ..... 414/622; 414/661

[58] Field of Search ..... 414/493, 497, 620–622, 414/661, 704, 739, 740; 294/67 AB

[56] References Cited

U.S. PATENT DOCUMENTS

| | | | |
|---|---|---|---|
| 2,828,878 | 4/1958 | LeTourneau . | |
| 2,873,874 | 2/1959 | Best et al. . | |
| 2,997,193 | 8/1961 | Dunham . | |
| 3,119,637 | 1/1964 | Eaves . | |
| 3,124,263 | 3/1964 | Eaves . | |
| 3,164,405 | 1/1965 | Lull | 414/622 X |
| 3,235,108 | 2/1966 | Drakulich . | |
| 3,295,882 | 1/1967 | Wallberg | 414/740 |
| 3,522,896 | 8/1970 | Newton | 414/620 |
| 3,669,293 | 6/1972 | Bryan et al. . | |
| 4,106,646 | 8/1978 | Weisgerber . | |

*Primary Examiner*—Robert G. Sheridan

*Attorney, Agent, or Firm*—Alan J. Hickman

[57] ABSTRACT

Log handling attachments frequently encounter inadvertent log loss during transportation, and damage to the logs and the log handling forks (36,38) due to excessive loading. A log handling attachment (14) is provided which has a pair of log carrying forks (36,38), a clamp (48), an ejector (88), a first power device (50) actuatable to pivotally move the clamp (48) between open and closed positions (51,53), a second power device (93) actuatable to move the ejector (88) between log accepting and log rejecting positions (94,96), and an apparatus (70) actuatable to move the clamp between the closed position (53) and a log grappling position (86) relative to the ejector (88) at which the logs are elevationally supported above the forks (36,38). Thus the problems of log loss, log damage and fork failure is alleviated. The log handling attachment (14) is particularly suited for use on a lift mast (12) of a lift truck (10).

17 Claims, 6 Drawing Figures

LOG HANDLING ATTACHMENT

DESCRIPTION

1. Technical Field

This invention relates generally to a log handling attachment and more particularly to a log handling attachment having log supporting forks, a log clamp and a log ejector. The log clamp and log ejector function additionally as a grapple for lifting logs elevationally from a fork supported position.

2. Background Art

Log handling attachments of the type having forks, a clamp and an ejector have been in commercial use for many years. Normally, such log handling attachments are mounted on a lift mast of a lift truck so that logs may be transported thereby.

It is desirable that the clamp of the log handling attachment be movable between an open position for loading and unloading logs from the forks to a closed position at which the clamp is adjacent the distal end of the forks relative to the lift mast. Further movement is not desirable as it tends to crush the logs and cause damage to them. This limited amount of clamp movement creates a problem in that the quantity or size of the load of logs to be carried is frequently less than full capacity. Thus the clamp does not adequately engage the logs which results in inadvertent movement and loss of the logs transversely of the forks.

Several attempts have been made to solve this problem. One attempt is shown in U.S. Pat. No. 2,873,874 dated Feb. 17, 1959 to C. W. Best et al utilizes the clamp and ejector to engage the logs while being supported on the forks. The linear design of the clamp however reduces the size of the full load capacity and therefore productivity. Because the clamp and ejector engage the log(s) while positioned adjacent the distal end of the forks the load carrying capacity and stability of the vehicle is reduced.

U.S. Pat. Nos. 3,119,637 dated Jan. 28, 1964 to J. J. Eaves and 3,124,263 dated Mar. 10, 1964 to J. J. Eaves depict two differently constructed clamping arrangements for engaging logs supported on forks. These two solutions require a linkage and cylinder arrangement of complex construction which is difficult to control, and does not include an ejector.

All of the attempted solutions discussed have an added common deficiency in that the clamp forces the logs against the forks to a degree determined by the operator. Therefor the force applied to the forks may become excessive resulting in breaking of the forks or inadequately engaged logs resulting in possible logs of the load.

The present invention is directed to overcoming one or more of the problems as set forth above.

DISCLOSURE OF THE INVENTION

In one aspect of the present invention a log handling attachment having a frame, a clamp, an ejector and a pair of forks is provided. A first power device pivotally moves the clamp between open and closed positions relative to the forks. A second power device pivotally moves the ejector between log accepting and log rejecting positions relative to the forks and an apparatus moves the first device to pivotally move the clamp between the closed position and a log grappling position relative to the ejector.

The log handling attachment thus provides a clamp which is movable in response to actuation of a first power device to a predetermined closed location for retaining a full load of logs supported on the forks. The clamp is further movable in response to actuation of the apparatus from the closed position to a grappling position relative to the ejector to force the less than full load of logs against the ejector and elevationally raise the logs from the forks and the ground.

Because the clamp has a predetermined closed position the determination as to when to stop actuation of the clamp is eliminated and the possibility of damage to the logs is reduced. Further since the clamp forces the logs against the ejector during movement to the grappling position and not against the forks the possibility of breakage of the forks is reduced.

Since the clamp moves in a direction toward the ejector and towards the vehicle upon which the log handling attachment is mounted in order to securely clamp the logs against the ejector the log carrying capacity of the vehicle will be increased and stability of the vehicle improved.

Also, the clamp and ejector work together in a crossing fashion to clamp the logs elevationally above the forks. Thus, the possibility of inadvertent log loss is reduced to a minimum.

BEST MODE FOR CARRYING OUT THE INVENTION

Figure 1:
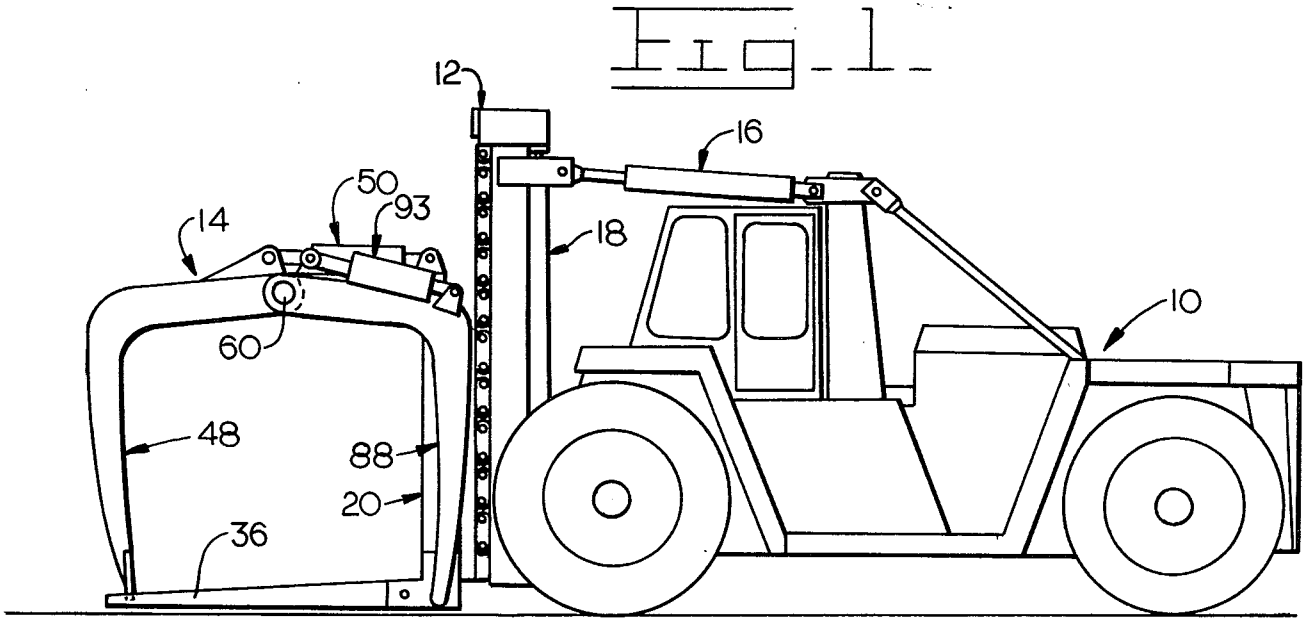
FIG. 1 is a diagrammatic side elevational view of an embodiment of the present invention showing a lift truck, and lift mast upon which a log handling attachment is mounted.

With reference to the drawings and particularly FIG. 1, a vehicle such as a lift truck 10 having a lift mast 12 pivotally mounted thereon and a log handling attachment 14 mounted on said lift mast and elevationally movable therealong is shown. A tilt jack 16 is provided for pivoting the lift mast 12 in forward and rearward longitudinal directions relative to the lift truck 10 in a conventional manner to assist in loading and unloading logs on the log handling attachment and positioning the log handling attachment for transporting the logs between locations.

At least one lift jack 18 is provided for elevationally moving the log handling attachment along said lift mast to position the log handling attachment 14 at a proper elevational location relative to the load to be engaged or disposed of and for positioning the load at a proper height for transport in a conventional manner.

Figure 2:
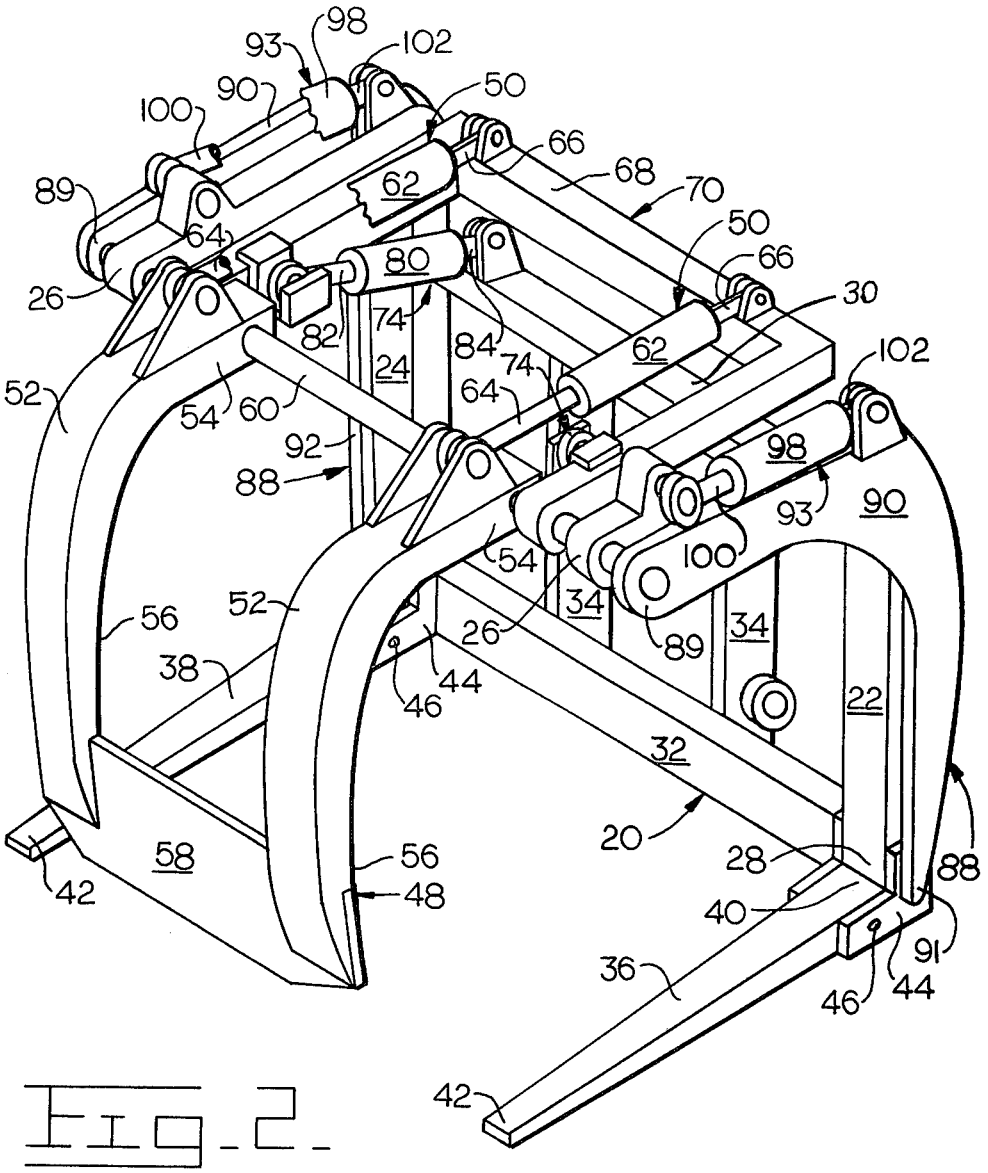
FIG. 2 is a diagrammatic isometric view of the log handling attachment showing a clamp and ejector in closed and log accepting positions respectively.
Figure 5:
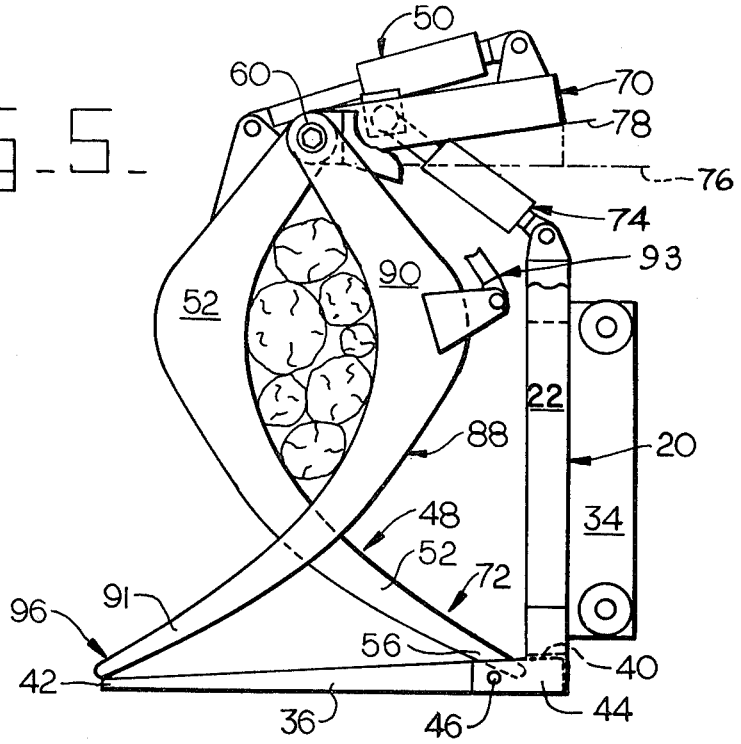
FIG. 5 is a diagrammatic side elevational view of the log handling attachment showing the clamp in the grappling position and the ejector in the log rejecting position for carrying a reduced size load of logs elevationally above the forks between the clamp and ejector.
Figure 6:
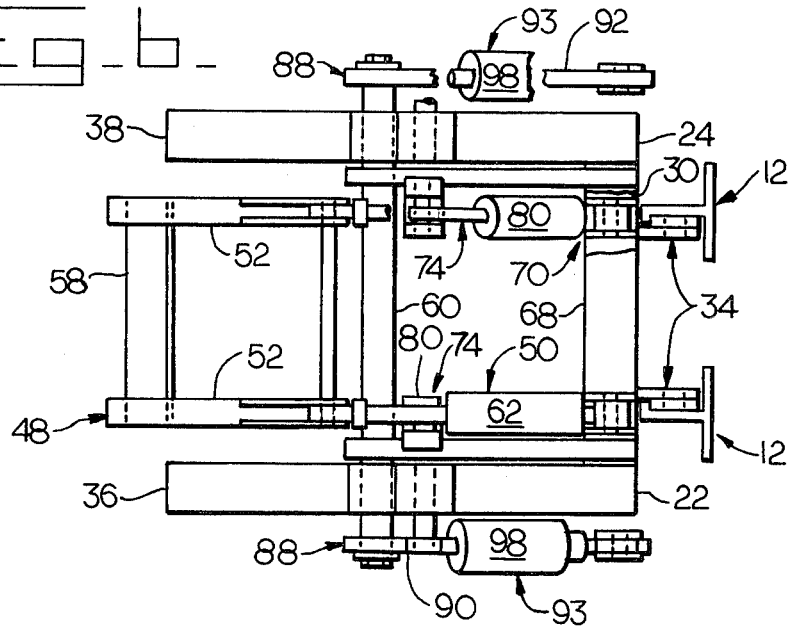
FIG. 6 is a diagrammatic top elevational view of the log handling attachment partially broken away to show the location of the second pair of jacks, one jack of a first pair of jacks, one jack of a third pair of jacks, and the transverse location of the clamp, forks, and ejector.

With reference to FIGS. 2, 5 and 6, the log handling attachment 14 has a frame 20. The frame 20 has first and second spaced apart side members 22 and 24 each having first and second end portions 26 and 28. The first and second side members are rigidly connected together by upper and lower connecting beams 30 and 32, such as by welding, which maintains the side members 22 and 24 at a preselected spaced apart parallel distance from one another. Preferably the side members 22 and 24 are fabricated of steel plate to form a box section and generally have an "L" shaped configuration. A pair of parallel roller brackets 34 are connected to the upper and lower connecting beams 32 at longitudinally spaced apart locations on said beams. These roller brackets mount the log handling attachment on the lift mast for rolling elevational movement along the lift mast in a conventional manner.

A first and a second fork 36 and 38 each having first and second ends 40 and 42 are pivotally connected at the first end thereof to the second end portion 28 of said first and second side members 22 and 24, respectively, by a respective connecting bracket 44 and pivot pin 46. Preferably the forks project from the first and second side members 22 and 24 in a forward longitudinal direction relative to said vehicle 10, substantially normal to the elevational movement of the log handling attachment and parallel to one another. The forks 36 and 38 are pivotally movable about said pivot pins 46 in a counterclockwise direction from said normal projecting position toward said first and second side members 22 and 24 and are restrained from movement in a counterclockwise direction from said normal projecting position through contact between the first end 40 of the forks and the second end portion 28 of their respective side members 22 and 24.

A clamp 48 is provided for retaining a full load of logs on said forks. The clamp 48 is pivotally connected to the frame 20 and movable by a first power device 50 between an open position 51 (FIG. 3) at which logs are freely loaded and unloaded from said forks and a closed position 53 (FIG. 4) at which a full load of logs are retained on said forks. The clamp 48 has a pair of "L" shaped clamp arms 52 each having a first end portion 54, a log engaging end portion 56 and a spade plate 58. The spade plate 58 is connected to the log engaging end portions 56 and maintains the clamp arms 52 at a preselected spaced apart distance from one another. The first end portion 54 of each clamp arm 52 is pivotally connected to a shaft 60 which is rotatably connected to the first end portion 26 of the first and second side members 22 and 24. The clamp 48 is located between the first and second side members 22 and 24 on the shaft 60 so that the log engaging end portions 56 are free to move in a parallel passing relationship relative to and between the first and second forks 36 and 38. Preferably the forks 36 and 38 extend in a plane perpendicular to the shaft length.

The first power device 50 includes a first pair of hydraulic jacks 62 each having first and second end portions 64 and 66. The first end portion 64 is pivotally connected to the clamp 48 and the second end portion 66 is pivotally connected to a support member 68 which is pivotally connected to the frame 20. Preferably the first end portion 64 of each first jack 62 is connected to a respective one of the pair of arms at the first end portion 54 thereof by a conventional clevis and pin arrangement. Similarly, the second end portion 66 of each first jack 62 is connected to the support member 68 by a conventional pin and clevis arrangement. Extension of first jacks 62 pivots the clamp 48 through a first range of movement in a counterclockwise direction about the shaft 60 from the open position 51 to the closed position 53. Conversely retraction of the first jack will pivot the clamp in a clockwise direction from the closed position 51 to the open position 53. It is to be noted that the log engaging end portions 56 of the clamp arms 52 are elevationally spaced from the second end 42 of the forks 36 and 38 at open position 53 and closely adjacent the second end 42 of the forks 36 and 38 at the closed position 51.

An apparatus 70 is provided to move the first power device 50 to pivotally move the clamp 48 between the closed position 53 and a log grappling position 72 (FIG. 5). The apparatus 70 includes the support member 68 and a third power device 74 connected to the support member and actuatable to pivot the support member between first and second angular positions 76 and 78 (FIG. 5).

Preferably, the support member 68 has a "U" shaped configuration and is pivotally connected to the shaft 60 at locations along the shaft outboard the pair of clamp arms 52 in a straddling relationship therewith and between the first and second side members 22 and 24 so as to prevent interference with pivotal clamp arm 52 movement. It is to be noted that the support member 68 may be mounted at other locations along the shaft 60, such as inboard of the clamp arms 52 and achieve the same end results as heretofore discussed.

The third power device 74 preferably includes a third pair of hydraulic jacks 80 each having first and second end portions 82 and 84. The first end portion 82 of each third jack 80 is connected to the support member 68 at a location adjacent the shaft 60 and the second end portion 76 of each jack 80 is pivotally connected to the frame 20. Extension of the third jacks 80 will move the support member 68 from the first angular position 76 to the second angular position 78 and retraction of the third jacks will move the support member from the second angular position 78 to the first angular position. These pivotal connections are made in a conventional manner by a clevis and pin arrangement.

Since the first jacks 62 are connected to the support member 68, pivotal movement of the support member about shaft 60 will cause the first jacks 62 to urge the clamp to pivot about the shaft 60. Specifically, with the first jacks 62 in the extended position, pivotal movement of the support member 68 in a counterclockwise direction from the first angular position 76 to the second angular position 78 will result in pivotal movement of the clamp 48 through a second range of movement from the closed position 53 to the grappling position 72 at which the log engaging end portions 56 of the clamp arms 52 are transversely located between the forks 36 and 38 and adjacent the first end 40 thereof. Conversely, movement of the support member 68 from the second angular position 78 to the first angular position 76 will result in pivotal movement of the clamp 48 from the log grappling position 72 to the closed position 53.

An ejector 88 for unloading logs from the forks 36 and 38 is provided. The ejector 88 includes first and second "L" shaped ejector arms 90 and 92 each having first and second end portions 89 and 91 and being pivotally mounted at the first end portion 89 to the shaft 60 at spaced apart longitudinal locations thereon. The first and second ejector arms 90 and 92 are preferably located on the shaft 60 transversely outboard of and adjacent the first and second side members 22 and 24, respectively and pivotally movable about the shaft in a parallel passing relationship with respectively adjacent forks 36 and 38. A second power device 93 pivotally moves the first and second ejector arms 90 and 92 between a log accepting position 94 (FIGS. 3 and 4) at which the second end portion 91 of first and second ejector arms 92 and 94 are adjacent the first end portion 40 of the first and second forks 36 and 38 respectively, and a log rejecting position (FIGS. 3 and 5), at which the second end portion 91 of the first and second ejector arms 90,92 are adjacent the second end portion 42 of the first and second forks 36 and 38, respectively.

The second power device 93 preferably has a second pair of hydraulic jacks 98, each having first and second end portions 100,102. One jack of the second pair is pivotally connected at the second end portion 102 thereof to the first ejector arm 90, and the first end portion 100 thereof is pivotally connected to the first end portion 26 of the first side member 22. The other jack of the second pair 98 is pivotally connected at the second end portion 102 thereof to the second ejector arm 92, and the first end portion 102 thereof is pivotally connected to the first end portion 26 of the second side member 24. These pivotal connections are made in a conventional manner such as by a pin and clevis. The first and second ejector arms 90 and 92 are pivotally movable through a third range of movement from the log accepting position 94 to the log rejecting position 96 (FIG. 3) in response to extension of the second pair of jacks 98 and pivotally movable from the log rejecting position 96 to the log accepting position 94 in response to retraction of the second pair of jacks 98. The second jacks are actuatable independently of one another or in unison to unload logs from the forks as determined by the vehicle operator. Control of the jacks 62, 80 and 98, as heretofore discussed, is achieved by selectively actuating a plurality of hydraulic control valves of a hydraulic system (not shown) in a conventional manner.

Because the clamp arms 52, ejector arms 90 and 92 and forks 36 and 38 all extend in different planes perpendicular to shaft 60 interference therebetween is avoided and parallel passing motion is achieved.

Although, the jacks 62, 80 and 98, and arms 52, 90 and 92 have been described in pairs in the preferred embodiment, it should be understood that a single arm and jack for each function or any combination thereof would be an equivalent.

INDUSTRIAL APPLICABILITY

Figure 3:
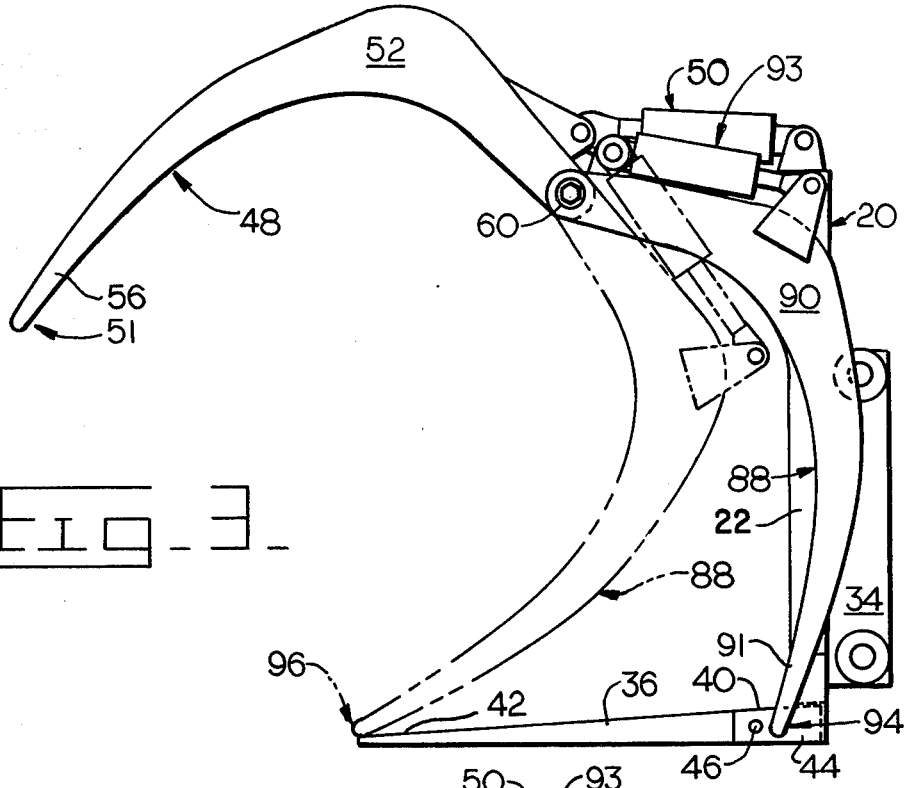
FIG. 3 is a diagrammatic side elevational view of the log handling attachment showing the clamp in the open position and the ejector in solid lines in the log accepting position for loading logs thereon and showing the ejector in phantom lines in the log rejecting position for unloading logs therefrom.
Figure 4:
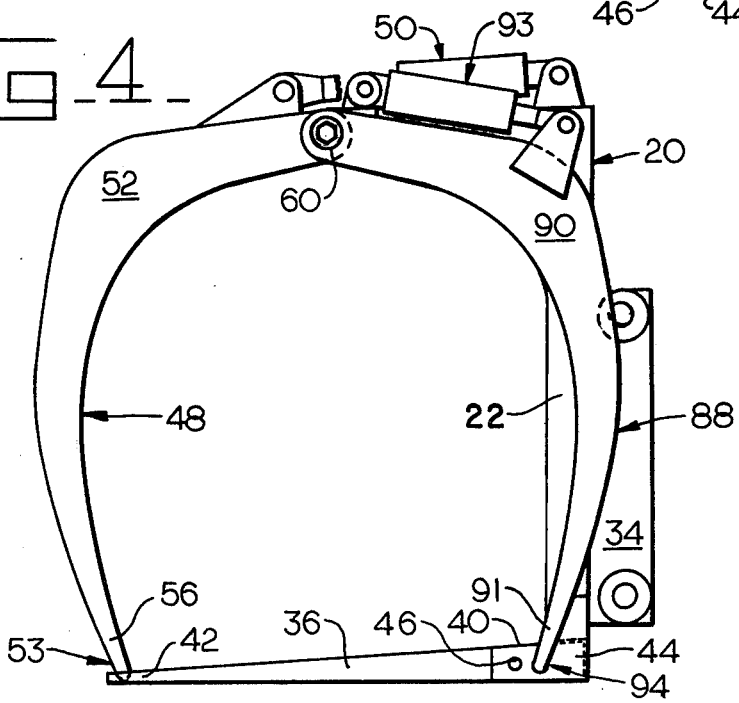
FIG. 4 is a diagrammatic side elevational view of the log handling attachment showing the clamp in the closed position and the ejector in the log accepting position for carrying a full load of logs.

In operation and with reference to the FIGS. 1–6, to pick up a full load of logs the operator of the lift truck 10 would first position the vehicle 10 and the log handling attachment 14 adjacent the logs to be loaded thereon. By tilting the lift mast 12 in a forward direction relative to the logs to be loaded and elevating the log handling attachment 14 on the lift mast 12 to the proper height the operator achieves a proper log handling position. The clamp 48 is then moved to the open position 51 and the ejector 88 to the log accepting position 94 as shown in FIG. 3. By driving the vehicle 10 toward the logs the forks 36 and 38 will floatingly engage the logs and load the logs thereon. When a full load of logs is engaged the operator actuates the first pair of hydraulic jacks 62 to extend and move the clamp 48 to the closed position 53 as shown in FIG. 4. The spade plate is first to engage the logs and urges the logs towards the lift mast 12 without significant damage to the logs. The pair of clamp arms 52 securely holds the full load of logs thereon. Because the first pair of jacks 62 are fully extended at the closed position of the clamp 48 the potential of crushing the logs or damaging the log handling attachment 14 is minimized. The operator then tilts the mast rearwardly and elevates the log handling attachment to the proper height for transportation.

To unload the logs the operator simply tilts the mast 12 forwardly and actuatably retracts first pair of jacks 62 to pivot the clamp 48 to the open position as shown in FIG. 3. In situations where all of the logs do not unload from the log handling attachment, such as on a slope where the inclination of the forks 36 and 38 is inadequate, the operator simply actuates one or both of the second hydraulic jacks 98 to pivot the ejector to the log rejecting position as shown in FIG. 3 to eject the logs therefrom.

Frequently the load of logs to be lifted is substantially less than full capacity of the log handling attachment 14. In such cases, the clamp 48 at the closed position does not adequately grasp the logs supported on the fork. Thus the logs being carried on the fork are jostled about during transport and frequently slide transversely (sideways) off of the forks 36 and 38. In order to alleviate this problem, apparatus 70 has been provided to move the clamp 48 to the log grappling position 72 to firmly engage the logs and restrain them thereon. To move the clamp 48 to the grappling position 72 the operator simply actuates the third pair of hydraulic jacks 80 to extend which pivots the support member to the second angular position 78. This pivotal movement causes pivotal movement of the clamp 48, through the hydraulically locked and extended first jacks 62, from the closed position 53 in a pivotal parallel passing relationship with the forks 36 and 38 to the log grappling position 72. Due to this motion and the "L" shape of the clamp arms 52 the logs are slid toward the lift mast 12. Simultaneously with this movement, the second pair of hydraulic jacks 98 are actuated to the extended position to pivotally move the ejector arms 90 and 92 to the log rejecting position 96 in a parallel passing relationship with the forks 36 and 38 and in a parallel passing and crossing relationship with the clamp arms 52. Because of this motion the logs are elevationally raised off of the forks and forceably clamped between the ejector arms 90 and 92 and the clamp arms 52 (FIG. 5).

Since the clamp arms 52 are pivotally connected to the shaft 60 and pivot in a direction toward the vehicle 10 to the log grappling position 72 the center of gravity of the load of logs being engaged are moved in a direction toward the vehicle 10. Thus the load carrying capacity and vehicle stability are increased.

Therefore it can be seen that the log handling attachment provides positive retention of a full load of logs as well as a smaller than full load in a simple and efficient manner without causing damage to the logs or the log handling attachment.

Other aspects, objects and advantages of this invention can be obtained from a study of the drawings, the disclosure and the appended claims.

We claim:

1. A log handling attachment (14), comprising:

a frame (20) having first and second side members (22,24), said side members (22,24) each having first and second end portions (26,28);

a pair of forks (36,38) each having first and second ends (40,42) and each being connected at said first end (40) to the second end portion (28) of a respective one of the first and second side members (22,24), said forks (36,38) extending from the second end portion (28) of said side members (22,24) in a forward direction relative to the frame;

a clamp (48) having a log engaging end portion (56) and being pivotally connected to the first end portion (26) of said side members (22,24);

an ejector (88) having a second end portion (91) and being pivotally connected to the first end portion (26) of said side members (22,24);

a support member (68) pivotally connected to the first end portion (26) of said side members (22,24), said support member (68) being free from connection with the clamp (48) and pivotally moveable about said pivotal connection;

first power means (50) for pivotally moving said clamp (48) about said pivotal connection between an open position (51) at which the log engaging end portion (56) of said clamp (48) is spaced elevationally from the second end (42) of said forks (36,38) and a closed position (53) at which the log engaging end portion (56) of said clamp (48) is adjacent the second end (42) of said forks (36,38), said first power means (50) being connected to and between the clamp (48) and said support member (68);

second power means (93) for pivotally moving said ejector (88) being a log accepting position (94) at which the second end portion (91) of said ejector (88) is adjacent the first end (40) of said forks (36,38) and a log rejecting position (96) at which the second end portion (91) of said ejector (88) is adjacent the second end (42) of said forks (36,38); and third power means (74) for moving said support member (68) about said pivotal connection between first and second angular positions, said first power means (50) being movable with said support member (68) to pivotally move said clamp (48) about said pivotal clamp connection between said closed position (53) and a log grappling position (72) at which the log engaging end portion (56) of said clamp (48) is adjacent the first end (40) of said forks (36,38).

2. The log handling attachment (14) as set forth in claim 1 wherein said third power means (74) includes;

a third jack (80) having first and second end portions (82,84) and being actuatable between extended and retracted positions, said first end portion (82) being pivotally connected to said support member (68) and said second end portion (84) being pivotally connected to said frame (20), said support member (68) being at said first angular position (76) in response to said third jack (80) being at said retracted position, and said support member (68) being at said second angular position (78) in response to said third jack (80) being at said extended position.

3. The log handling attachment (14) as set forth in claim 2 wherein said first power means (50) includes;

a first jack (62) having first and second end portions (64,66) and being actuatable between extended and retracted positions, said first jack first end portion (64) being pivotally connected to said clamp (48) and said first jack second end portion (66) being pivotally connected to said support member (68), said clamp (48) being at said open position (51) in response to said first jack (62) being at said retracted position and said clamp (48) being at said closed position (53) in response to said first jack (62) being at said extended position, said first jack (62) being movable with said support member (68) to forcibly move said clamp about said pivotal connection (48) between said closed and grappling positions (53,72), said clamp (948) being at said second closed position (53) in response to said first jack (62) being at said extended position and said support member (68) being at said first angular position (76), said clamp (48) being at the grappling position (72) in response to said first jack (62) being at the extended position and said support member (68) being at the second angular position (78).

4. The log handling attachment (14), as set forth in claim 3, wherein said second power means (93) includes;

a second jack (98) having first and second ends (100,102) and being actuatable between extended and retracted positions, said first end (100) being pivotally connected to said frame (20) and said second end portion (102) being pivotally connected to said ejector (88), said ejector (88) being at said log accepting position (94) in response to said second jack (98) being at said retracted position and said ejector (88) being at said log rejecting position (96) in response to said second jack (98) being at said extended position.

5. The log handling attachment (14) as set forth in claim 3 wherein the first end portion (82) of said third jack (80) is pivotally connected to said support member (68) at a location closely adjacent to the pivotal connection of the support member (68) to the first end portion (26) of the side members (22,24).

6. The log handling attachment (14) as set forth in claim 5 wherein said support member (68) has a generally U-shaped configuration, said support member (68) straddling the clamp (48) at the pivotal connection of said support member (68) to the first end portion (26) of said side members (22,24).

7. The log handling attachment (14) as set forth in claim 1 including;

a shaft (60) connected to and between the first end portion (26) of the first and second side members (22,24), said clamp (48), ejector (88) and support member (68) each being pivotally connected to said shaft (60).

8. The log handling attachment (14) as set forth in claim 7 wherein said ejector (88) includes;

first and second ejector arms (90,92) each having a first end portion (89) and being pivotally connected at said first end portion (89) to said shaft (60) at spaced apart locations along said shaft (60) and outboard of said first and second side members (22,24), respectively, said clamp (48) and said support member (68) being positioned along said shaft (60) between said first and second side members (22,24).

9. The log handling attachment (14) as set forth in claim 7 wherein said forks (36,38) extend from said frame (20) in a direction substantially normal to said shaft (60) and parallel to one another, said clamp (48) being pivotally movable in a parallel passing relationship with said forks (36,38) in response to being moved between said open and grappling positions (51,72), and said ejector (88) being pivotally movable in a parallel passing relationship with said forks (36,38) in response to being moved between said log accepting and log rejecting positions (94,96).

10. The log handling attachment (14) as set forth in claim 8 wherein said first ejector arm (90) is located transversely outboard one of said forks (36), said second ejector arm (92) being located transversely outboard the other of said forks (38), and said clamp (48) being transversely located between said forks (36,38).

11. The log handling attachment (14) as set forth in claim 1 wherein said second power means (93) and said means for moving (70) said first power means (50) are simultaneously actuatable to pivot said clamp (48) and said ejector (88) in directions towards each other and in a passing relationship with each other.

12. The log handling attachment (14) as set forth in claim 11 wherein said clamp (48) and said ejector (88) are movable in a parallel passing direction relative to said forks (36,38) in response to said pivotal movement towards each other to engage a log supported on said forks (36,38) and lift said log elevationally above said forks (36,38).

13. In a lift mast (12) having a log handling attachment (14) mounted thereon and elevationally movable relative thereto, said log handling attachment (14) having a pair of forks (36,38), a clamp (48), a frame (20) and an ejector (88), said frame (20) having first and second spaced apart side members (22,24), said side members (22,24) having first and second end portions (26,28), said pair of forks (36,38) having a second end (42) and being mounted on the second end portion (28) of the first and second side members (22,24), respectively, and extending from said side members (22,24) in a direction substantially normal to the elevational movement of said log handling attachment (14) and substantially parallel to one another, said clamp (48) having a first end portion (54) and a log engaging end portion (56) and being pivotally connected at said first end portion (54) to the first end portion (26) of said side members (22,24), and said ejector (88) having a first end portion (89) and a second end portion (91) and being pivotally connected at said first end portion (89) to the first end portion (26) of said side members (22,24), the improvement comprising:

a support member (68) pivotally connected to the first end portion (26) of said side members (22,24), said support member (68) being free from connection with the clamp (48) and pivotally movable about said pivotal connection between first and second angular positions (76,78);

a first jack (62) connected to and between the first end portion (54) of said clamp (48) and support member (68), said first jack (62) being actuatable to pivotally move said clamp (48) between a closed position (53) at which the log engaging end portion (56) is adjacent the second end portion (42) of said forks (36,38) and an open position (51) at which the log engaging end portion (56) is elevationally spaced from the second end portion (42) of said forks (36,38);

a second jack (98) connected to and between said ejector (88) and said frame (20), said second jack (98) being actuatable to pivotally move said ejector (88) in a parallel passing relationship relative to said forks (36,38) between a log accepting position (94) at which the second end portion (91) of said ejector (88) is adjacent the second end portion (28) of said side members (22,24) and a log rejecting position (96) at which the second end portion (91) of said ejector (88) is adjacent the second end portion (42) of said forks (36,38); and a third jack (80) connected to and between the frame (20) and the support member (68) at a location adjacent the pivotal connection of the support member (68), said third jack (80) being actuatable to pivotally move said support member (68) between said first and second angular positions (76,78), said first jack (62) being movable with said support member (68) to pivotally move said clamp (48), in a parallel passing motion relative to said forks (36,38), between said closed position (53) and a log grappling position (72) at which the log engaging end portion (56) of the clamp (48) is adjacent the second end portion (28) of said side members (22,24).

14. The lift mast (12) as set forth in claim 13 wherein said second and third jacks (98,80) are simultaneously actuatable to pivot said ejector (88) from said log accepting position (94) to said log rejecting position (96) and said clamp (48) from said closed position (53) to said log grappling position (72).

15. The lift mast (12) as set forth in claim 14 wherein said clamp (48) has a log engaging end portion (56) and said ejector (88) has a second end portion (91), said log engaging end portion (56) and said ejector second end portion (91) crossing one another at the log grappling and log rejecting positions (72,96) of said clamp (48) and said ejector (88), respectively.

16. The lift mast (12) as set forth in claim 13, including;

a shaft (60) connected to said frame (20), said clamp (44) and said ejector (88) each having a first end portion (54,89) and being pivotally connected at said first end portion (54,89) to said shaft (60), said support member (68) being pivotally connected to said shaft (60).

17. The lift mast (12) as set forth in claim 16 wherein said first, second and third jacks (62,98,80) are hydraulic jacks.

* * * * *

UNITED STATES PATENT AND TRADEMARK OFFICE

CERTIFICATE OF CORRECTION

PATENT NO. : 4,459,080

DATED : July 10, 1984

INVENTOR(S) : Llewellyn L. Walters, et al

It is certified that error appears in the above-identified patent and that said Letters Patent are hereby corrected as shown below:

Column 7, line 35: delete "being" and insert --between--.

Column 8, line 14: delete "second".

Signed and Sealed this

*Twelfth* Day of *March 1985*

[SEAL]

*Attest:*

DONALD J. QUIGG

*Attesting Officer* *Acting Commissioner of Patents and Trademarks*